US008511209B1

(12) United States Patent
Bishop et al.

(10) Patent No.: US 8,511,209 B1
(45) Date of Patent: Aug. 20, 2013

(54) ERGONOMIC ONE- OR TWO-HANDED TOOL HANDLE OR SUPPORT

(76) Inventors: Lawrence Bishop, Karlskoga (SE); Lew Bishop, West Union, IA (US)

( * ) Notice: Subject to any disclaimer, the term of this patent is extended or adjusted under 35 U.S.C. 154(b) by 0 days.

(21) Appl. No.: 13/487,582

(22) Filed: Jun. 4, 2012

(51) Int. Cl.
*B25G 1/01* (2006.01)

(52) U.S. Cl.
USPC ..... 81/489; 81/488

(58) Field of Classification Search
USPC ..... 81/488, 489, 177.1, 427.5; 294/25, 294/26, 19.1
See application file for complete search history.

(56) References Cited

U.S. PATENT DOCUMENTS

| | | | | |
|---|---|---|---|---|
| 120,607 | A | 11/1871 | Alsip | |
| 712,843 | A | 11/1902 | Paul | |
| 933,647 | A | 9/1909 | Hunt | |
| 3,751,094 | A | 8/1973 | Bohler | |
| 4,128,266 | A * | 12/1978 | Vaslas | 294/58 |
| 4,787,661 | A | 11/1988 | Rutledge | |
| 4,794,667 | A | 1/1989 | Nelson et al. | |
| 5,065,475 | A | 11/1991 | Watt | |
| 5,137,317 | A | 8/1992 | Bieniek | |
| 5,156,429 | A * | 10/1992 | Adams | 294/25 |
| D352,872 | S | 11/1994 | Crockett | |
| 5,716,087 | A | 2/1998 | Backich et al. | |
| 5,771,535 | A | 6/1998 | Blessing | |
| 5,826,929 | A | 10/1998 | Tisbo et al. | |
| 5,890,259 | A * | 4/1999 | Sarac | 16/422 |
| 5,921,600 | A * | 7/1999 | Lucas | 294/58 |
| 6,199,245 | B1 | 3/2001 | Blessing | |
| 6,485,076 | B1 | 11/2002 | Chang | |
| 6,798,348 | B1 | 9/2004 | Wilker et al. | |
| D520,819 | S | 5/2006 | Onembo | |
| 7,134,208 | B2 | 11/2006 | Wilkinson et al. | |
| 7,213,658 | B2 | 5/2007 | Hurt | |
| D626,388 | S | 11/2010 | Greenly et al. | |
| 7,866,720 | B2 | 1/2011 | Haws et al. | |
| 2010/0132515 | A1 * | 6/2010 | Cox | 81/45 |

* cited by examiner

*Primary Examiner* — Robert Scruggs
(74) *Attorney, Agent, or Firm* — Nikolai & Mersereau, P.A.; C. G. Mersereau

(57) ABSTRACT

Auxiliary tool handling devices incorporating ergonomic-advantage designs selected from auxiliary handles, active movable forearm supports, foot pads, and wheels and various combinations of these are disclosed that allow many common tools to function in a safe, secure, convenient, ergonomic and efficient manner in performing many common chores.

39 Claims, 11 Drawing Sheets

50
54
56
58
60
62
63
64
66
67
68
70

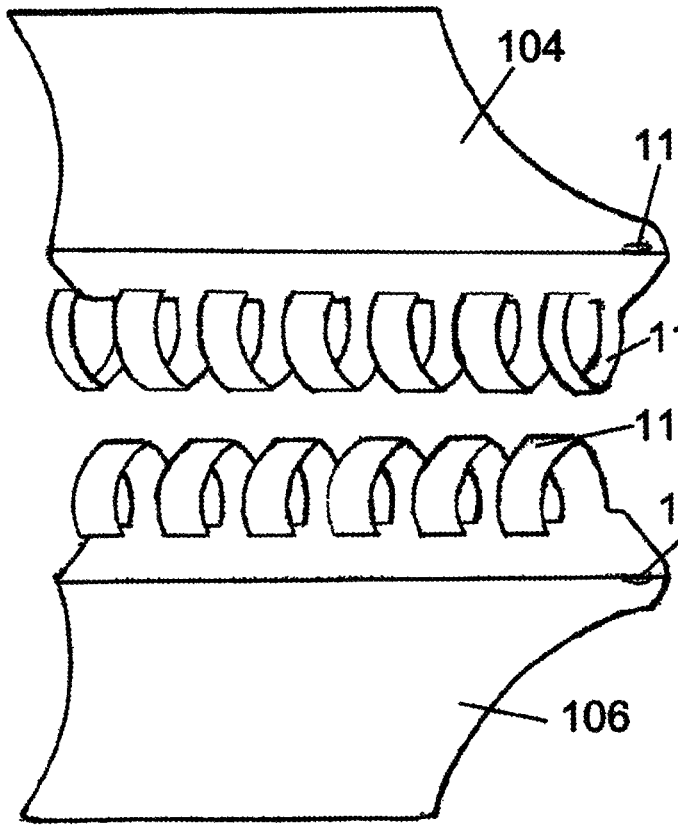
Fig. 5
Fig. 4
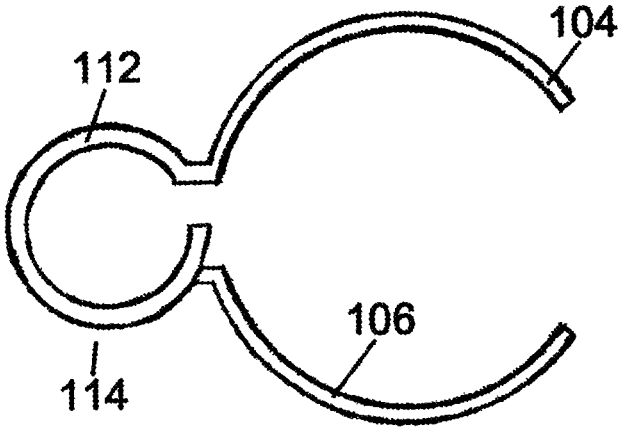
Fig. 7

120
122
124
126
128
130
132
134
135
136
137
138
140
142
144
150
152
154
156
158

Fig. 19
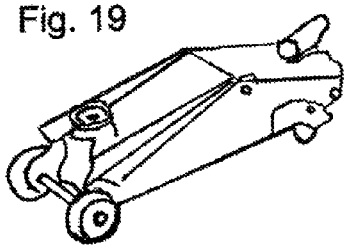
Fig. 20
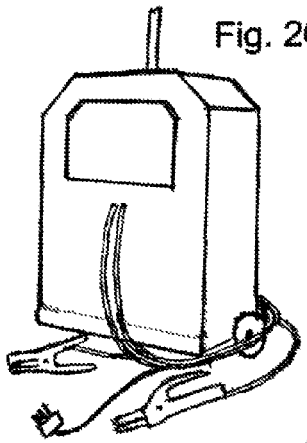
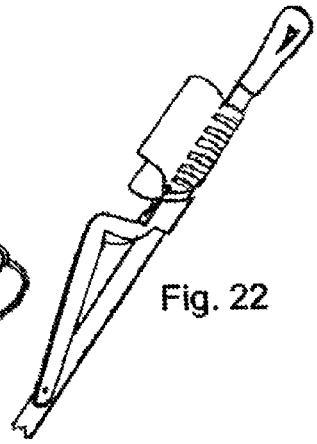
Fig. 22
Fig. 21
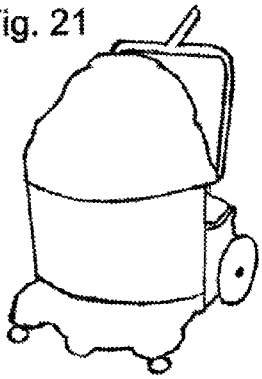
Fig. 23
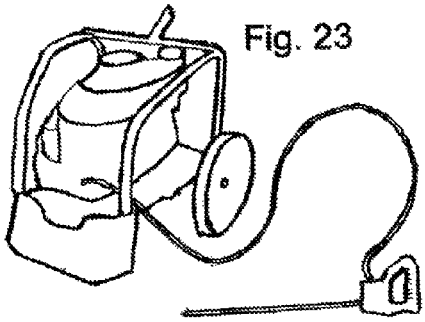
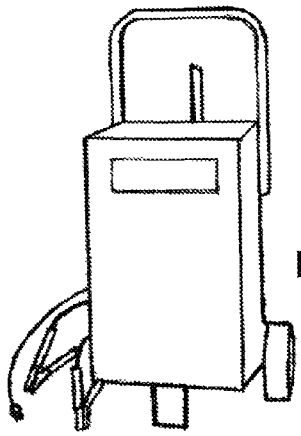
Fig. 24

ERGONOMIC ONE- OR TWO-HANDED TOOL HANDLE OR SUPPORT

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates to ergonomic adaptations for devices that serve as tools, particularly handles to tools, as well as support devices such as crutches. The devices are provided with auxiliary handling additions of various configurations having a variety of geometries. These include hand grips, foot pads, forearm supports, etc., in order to facilitate the ergonomic, secure and convenient function of devices, including, but not limited to shovels, snow scrapers, rakes, brooms, hand grips, crutches, lawn-edgers, paint-rollers, squeegees, line-markers, wheeled service jacks, hand trucks and dollies, and similar tools.

II. Related Art

Much manual labor is performed using tools whose designs have remained relatively static for tens, if not hundreds, of years. Some of the most common acts which continue to be performed by a wide variety of individuals are shoveling, sweeping, raking and wheeling/moving rolling objects. Many of those who perform these tasks are experienced and practiced in the use of the appropriate tools and proper techniques. Nevertheless, injuries are commonplace, partly because many of the tasks are performed sporadically or occasionally by individuals not specifically conditioned or educated to use the tools in a manner to avoid such injuries, and partly because the tools themselves are simply not properly engineered to reduce strain and better suit the ergonomic requirements of human users.

In the case of generally straight-handled tools such as shovels, rakes and push brooms, most handle designs have taken a two-handed approach, requiring not only two functioning arms and wrists, but also relying heavily on a user's back to transfer and mediate forces from one hand to the other hand. The particular combination of forces presented through the two hands is what performs the work, using the tools. In most cases, the body struggles to exert force at locations some distance from the body, which often results in muscle strain, pinched nerves and other injury.

Another issue with most of these conventional tools is that for many uses, one must perform fine control and coarse strength muscular actions simultaneously using the same wrists or arms. For example, while scraping or shoveling snow, one must typically retain a firm grip to control the orientation of the shovel, while exerting considerable force to push the scraper or shovel into snow or ice. Likewise, when raking, one must pull back the tool with the dirt, gravel or leaves being raked, while maintaining a tight grip on the shaft. It is believed that the probability of muscle injuries is increased when the same muscle groups are required to perform both types of activities at the same time.

Alternative handle designs have been devised which have attempted to address some of these problems. An early concept is shown in U.S. Pat. No. 120,607, issued to Frank Allsip in 1871. Allsip devised an auxiliary handle for attachment to shovels, forks and the like, which attached to the upper handle shaft and extended above the tool head near the point of attachment to the straight handle. This provided a hand grip location closer to being above the center-of-gravity of the loaded tool head, thereby reducing back strain on a user picking up, carrying or throwing the load. Because his auxiliary handle was attached only at one point to the tool, itself, however, the rotational stability of the load was less than optimal and controlling the pitch or angle of the tool head was possibly actually made more difficult as it relied on the user gripping the upper auxiliary handle tightly and attempting to twist it. Nevertheless, Allsip's design remains of interest as an early attempt to improve the ergonomics of such tools.

Various other subsequent innovations have led to a series of accessory handles designed to fasten to traditional straight handles at some distance from the tool head, allowing the user to bend or reach less in order to obtain a grip closer to the lower end of the tool. Although they represent some improvement and some of these continue to be recommended or to be used, several important drawbacks remain. To date, these designs fail to locate the auxiliary handle close to the effective center-of-gravity of the loaded tool head and they all fail to provide sufficient strength and stability at the hand grip.

In addition, fixed forearm supports have been provided with or without an upright handle to allow some operations to be performed one-handed. Unfortunately, these designs make it difficult for one to switch arms and/or they do not enclose the forearm, thereby forcing the user to exert more effort to orient and control the tool handle.

There remains a definite need to provide an ergonomic auxiliary tool device that overcomes the shortcoming of previous devices.

SUMMARY OF THE INVENTION

By means of the present invention, auxiliary tool operating devices are provided incorporating ergonomic-advantages selected from auxiliary handles, active movable forearm supports, foot pads, and wheels and various combinations of these allow many common tools, particularly tools having a functional tool head device at the end of a generally straight handle member, to function in a safe, secure, convenient, ergonomic and efficient manner in performing many common chores, such as shoveling snow, scraping ice, raking leaves, grasping or engaging hard-to-reach items, moving and guiding wheeled equipment and devices, and moving a user about on medical supports (crutches). Other advantages include increased tool control, making operations quicker and less tiring while reducing the risk of strain and injury. The present auxiliary handle devices also make it easier to relocate and reposition tools, in some cases replacing many formerly two-handed operations with one-handed operation.

The present development shifts the points of leverage and relocates the effective center-of-gravity of heavy loads through the addition of auxiliary grip locations on the handles and a multi-point attachment geometry to and above the tool or implement head, and the addition of a forearm support that shifts the effective load of the upper arm holding the tool from the wrist area back towards the elbow. The forearm-support also partially encloses the forearm when the user squeezes the hand grip, thereby making it easier for the user's arm to remain properly situated and increasing user control. For tools that might require additional force in use, such as snow shovels or scrapers, integrated, strengthened supports are provided that make it easier for the user to firmly push with a foot, as well as with an upright hand grip that allows the user to push more from the elbow and shoulder.

The present invention involves devices attached as handles by themselves or through incorporation with an existing handle, to tools including, but not limited to axe, barn scraper, dandelion digger, distance measurer, extendable grabber, fork, garden rake, trowel, hammer, hand saw, hatchet, hoe, hose reel, lawn edger, lawn mower, lawn spreader, lawn trimmer, leaf rake, line marker, mall, mason's float, mop, paint roller, pick axe, pruner, push broom, shovel, snow shovel, splitter, sponge mop, squeegee, tree saw, weed cutter/trimmer, weed puller/remover, wheeled service jack, and wire spool reel. These include a variety of embodiments. Different combinations of features described in the present invention may apply to improve the function of different tools.

The fundamental concepts of the present invention include an ergonomic cross hand grip designed to be located above and behind a loaded tool. This is accomplished by attaching a symmetrical geometrical structural component (trapezoidal, triangular, rectangular, etc.) to the rear of the tool head, near where the traditional handle attaches to the tool head. The longer, lower portion of a trapezoidal structure serves to stiffen and stabilize the tool and presents a convenient foot-kicking pad or prominence. The sides of the trapezoidal structure stiffen the device laterally and raise the height of the top, where a tee or "D" shaped hand grip is located. In this manner, the user's back is not required to bend nearly as far in order to grasp the hand grip. The gripping hand also avoids contact with material to be engaged by the tool.

Another part of the device extends from the center of the top of the trapezoid, at the point the hand grip is located and is attached to the upper portion of a conventional straight tool handle, thereby replacing the function of the traditional handle as an area to grasp and allowing the user to select a conventional grip for optimal location of fulcrum support at a more convenient and ergonomic height. Addition of this stabilizing member provides a secure third leg to the top of the trapezoid, adding significant strength and stability implicit in a tripod.

The stabilizing member is attached to the original handle and extends by either intersecting and projecting on the same plane, or by turning back (at the same angle as the intersecting projection created to the original handle) to create a hand-hold pusher, supplemented by a movable forearm support to which it mates, thereby providing a stable grip that enables one-handed operation. A control lever located in the hand grip at the end of the hand-hold pusher (formed from the aforementioned member) activates the device to securely encircle the forearm, and conversely, to release that engagement.

The intersecting version of the hand grip and forearm support further enables an attached tool to be inverted, which is the case of a snow shovel, for example, that is thereby converted into a snow pusher/scraper. When used in this fashion, the short end of the modified trapezoidal structure is positioned as a fulcrum for use in raising the tool accurately and easily above irregularities on the surface to be scraped. The modified trapezoidal fulcrum can be further enhanced by placing an axle horizontally through it, and affixing wheels to each end, allowing for increased mobility.

While the illustrated and preferred stabilizing fulcrum geometric shape is a trapezoid or modified trapezoid, as indicated above, it is contemplated that other geometric shapes including triangular and quadrilateral shapes, as well as curved modifications, could be used instead.

The development is also in the form of virtual shapes that may be integrally designed into a tool head or attached to a tool as a separate unitary shaped member that slips onto a tool.

BRIEF DESCRIPTION OF THE DRAWINGS

FIG. 4 is a perspective view of one-half, the right side, of the movable forearm support shell shown in FIG. 3;

FIG. 5 is a perspective view of one-half, the left side, of the movable forearm support shell shown in FIG. 3;

FIG. 7 is a front side view of the two halves properly placed together, as when a straight handle shaft would be inserted;

FIG. 18 is a side perspective view, shown with parts removed, of a portion of an active movable upper forearm support in accordance with the invention assembled on a traditional straight handle shaft, ready to be connected to a control lever contained in the longer tube with a control link; two control links, depicted from different angles, are shown next to the control link and forearm support, as well as a control lever placed within the longer tube and another control lever beside the control links;

FIG. 19 is a perspective view of a wheeled service jack, which is adapted to receive the handle device shown in FIG. 22;

FIG. 20 is a perspective view of a wheeled welding unit, which is adapted to receive the handle device shown in FIG. 22, having an active upper forearm support and attached to a traditional straight handle;

FIG. 21 is a perspective view of a shop vacuum, which is adapted to receive the handle device shown in FIG. 22;

FIG. 22 is a perspective view of another embodiment of a handle in accordance with the invention having an active upper forearm support attached to a traditional straight handle, shown terminating in a straight shaft, suitable to be attached to various suitable tools;

FIG. 23 is a perspective view of a wheeled pressure washer, which is adapted to receive the handle device shown in FIG. 22;

FIG. 24 is a perspective view of a wheeled battery charger unit, which is adapted to receive the handle device shown in FIG. 22;

DETAILED DESCRIPTION

The following description details several exemplary embodiments illustrating the common theme of the present invention. It should be noted that the detailed descriptions are intended by way of example only and are not intended to limit the scope of the invention in any respect. It will be further understood that the embodiments of the invention can be modified by those skilled in the art while remaining in keeping with the inventive concepts.

It will be appreciated that the present invention advantageously separates the tiring and problematic need for the user to perform large-muscle actions (or those requiring considerable strength) with the same muscles that are used at the same time for fine-muscle control of the tool or implement. Repetitive use injuries and muscle strains are believed to occur more frequently when the same fingers, wrist or hand are used to support or maneuver a heavy tool as are used to control or activate it.

It has been found that the need to perform tasks at the extreme range of muscular motion is reduced and back strain avoided by moving the center of gravity closer to the body, whenever possible, allowing the weight to be borne more by the shoulders than the back muscles and enabling a more upright posture to be assumed. This reduces injuries that commonly occur when a load is borne by muscles at the extremes of travel, as well as when weight is manipulated at a distance from the torso.

Another important advantage of the use of the present invention is that it avoids requiring muscles to remain contracted for extended periods of time or to twist the trunk of the body, as is often the case when a user employs a standard scoop or snow shovel to carry a heavy load over a distance and must keep the load-bearing arm bent at the elbow. Auxiliary handles in accordance with the invention avoid this situation by enabling the load-bearing arm to be extended downward next to the body, which also allows the upper controlling, non-load-bearing arm to be comfortably away from the body.

The devices of the invention are easily integrated or retrofitted to current tool designs, minimizing weight and increasing durability through advantageous selection of materials and inherently stronger geometries, and minimizing space requirements for manufacturers and distributors of the invention during shipping and inventory operations through simple and modular assembly and nearly-flat folding components.

The figures illustrate several embodiments which exemplify the principles of the invention as it is applied to a variety of tools.

Figures 1A, 1B, 1C, 2:
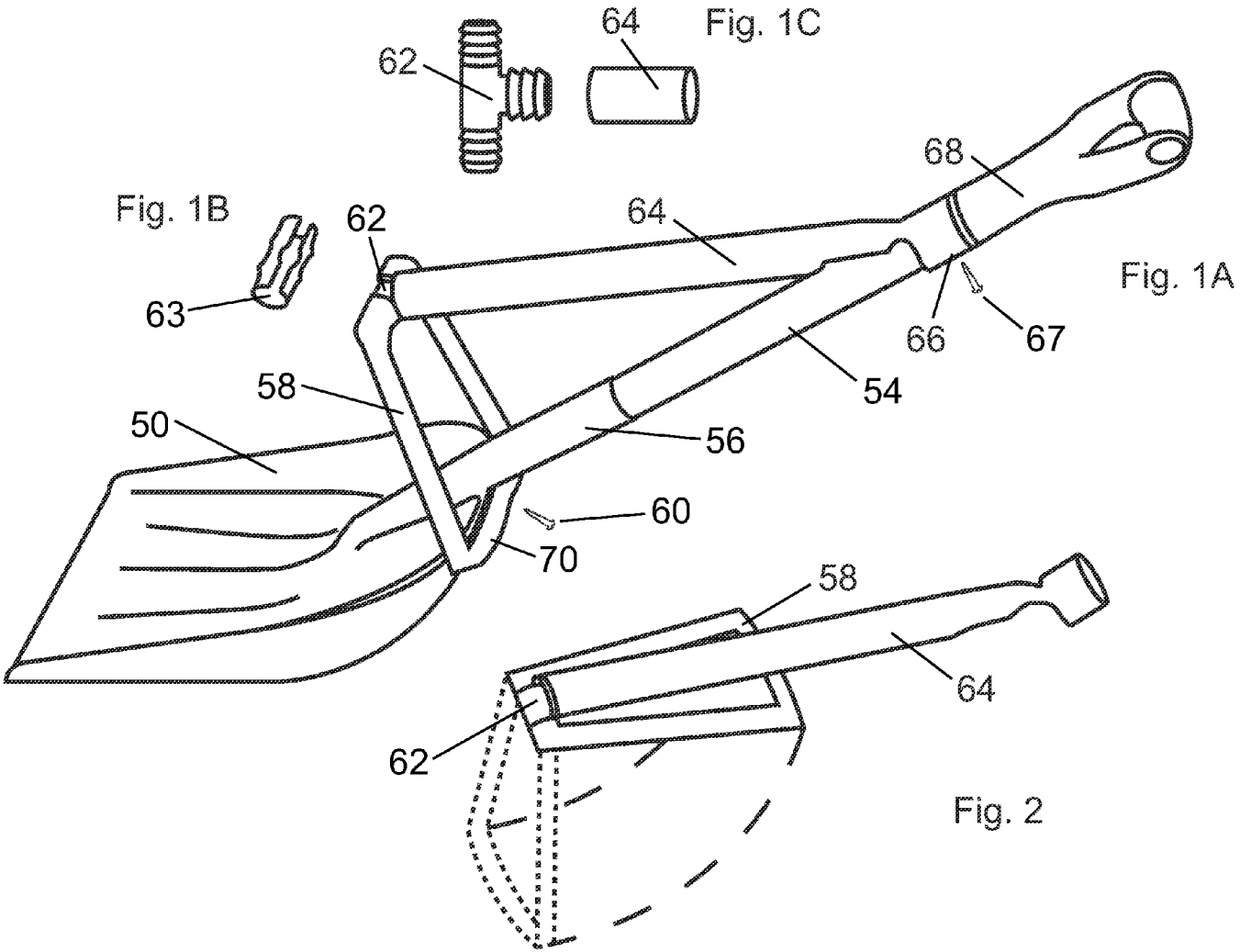
FIG. 1A is a perspective view of a scoop shovel incorporating one embodiment of the device in which a lower auxiliary handle having a tubular trapezoidal structure engaging the shovel head forms an ergonomic auxiliary handle through attachment to another longer tube, extending from the top of the trapezoid to the traditional straight handle.
FIGS. 1B and 1C show parts broken away for clarity.
FIG. 2 is a perspective view of the entire auxiliary handle device of FIG. 1, pivoted at the tee joining the trapezoid and the longer tube, to facilitate nearly flat shipment and storage.

FIGS. 1A-1C show an embodiment of the current invention configured to suit a conventional scoop shovel in its normal pushing or shoveling orientation. The device contains a scoop shovel head 50 used for shoveling snow, sand or other often heavy substances, with a traditional straight handle shaft 54 inserted in neck 56 of the scoop shovel head 50. A tubular trapezoidal structure 58 is secured to the shovel head 50 as by a screw 60 at a point where the center of the bottom of the trapezoidal structure 58 meets the underside of the shovel head 50.

The upper segment or top of the tubular trapezoidal structure 58 is joined using a tee member 62 which further joins the tubular trapezoidal structure 58 to a relatively long tube member 64. This construction forms a cross hand grip, which extends from the tee toward the straight handle shaft 54. The long tube member 64 is angled and cut around approximately 270 degrees of its circumference to allow the free end to engage and be secured to the shaft 54, ending in a cylindrical collar 66, secured as shown by a threaded member, as screw 67. Shaft 54 is shown with a D handle 68 mounted on its upper end. Optional tee cover grip 63 is shown as unassembled prior to snapping over tee 62.

FIG. 2 shows how the auxiliary handle of FIG. 1A, as configured for use with a scoop shovel, can be rotated about the tee joint 62 to assume a relatively flat position for compact shipping, with the trapezoidal tubular structure 58 rotated against long tube member 64.

It should be noted that the embodiments of the ergonomic auxiliary tool handling devices of the invention can be readily assembled and added to existing tools. They are designed to use removable fastening devices which makes them not only easy to retrofit to existing tools but easily removable and replaceable on other tools. Several embodiments are foldable on themselves for convenient shipping and storage, as shown in FIG. 2.

In the embodiment of FIG. 1A, the lower, longer segment 70 of the tubular trapezoidal structure 58 forms a broad and straight foot pad that allows the user to more easily and safely push the shovel head into snow, sand, grain, concrete mixture or other substance to be moved. Importantly, in addition, the task of lifting and carrying the shovel with shovel head 50 loaded is greatly facilitated by the auxiliary structure because the tubular trapezoidal structure 58 provides an elevated cross grip at the tee junction 62, as well as an additional grip area provided along the tube member 64, between the tee junction and the intersection with the straight shaft 54.

In this manner, in addition to reducing the need of the user to bend over in order to pick up and carry a loaded shovel head, the device locates the effective center-of-gravity of the load almost directly below the cross grip handle at the tee joint. This reduces the strain placed on a user's back. The tubular trapezoidal structure 58 in combination with the attachment to the straight shaft 54 also creates a tripod-like stability for the device, thereby reducing the tendency of the loaded blade to twist and unintentionally dump its contents. Ergonomically, this obviates the need for the user's wrist to be held tight around the hand grip, as would typically be necessary with a traditional shovel handle.

The additional cross grip handle and grip area along the long tube member 64 also make it much easier to use the shovel one-handed as is sometimes done in order to redirect the flow of concrete mix or other substances, or to level an area, such as the top of a load of grain in a wagon or truck bed.

Figure 28:
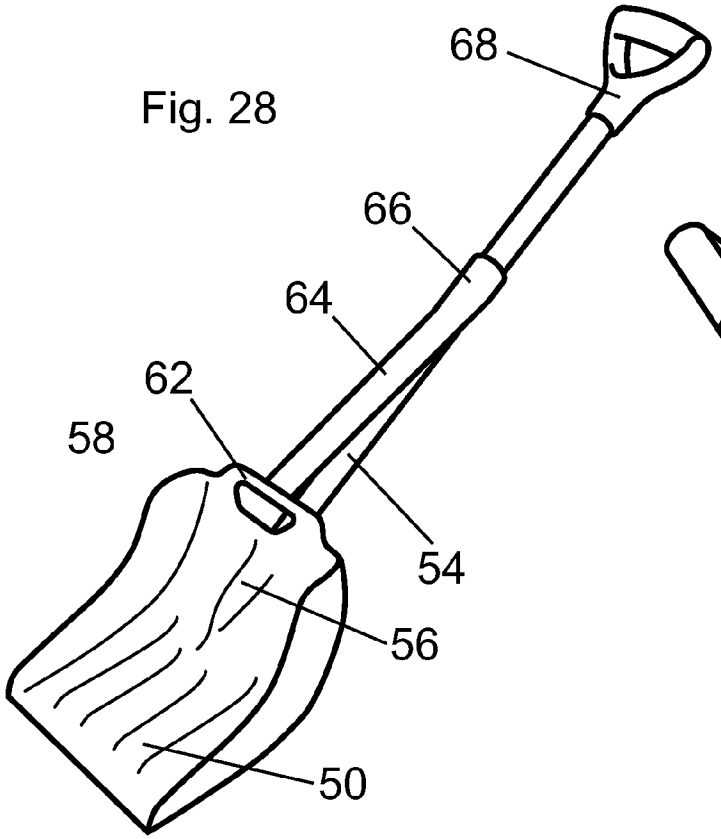
FIG. 28 is a top perspective view of a shovel which has been fabricated using unit-body construction, encompassing a virtual trapezoidal structure having an integrated tee grip attached to the original handle by a tubular structure.

FIG. 28 is a scoop or snow shovel with the upper segment of the modified shovel blade 50 itself configured to encompass a virtual trapezoidal structure which provides the same function as trapezoidal structure 58 in FIGS. 1A and 2 and which is connected through its associated virtual tee 62 which joins that modified scoop blade structure 56 to an auxiliary tubular structure 64, thereby forming a cross hand grip as it connects to the long tube 64 away from the blade unit 50 toward the base of the "D" handle 68. The long tube 64 captures and attaches to the straight shaft 54 through a 270° cut which allows the segment 66 to be angled and enlarged to surround shaft 54 and be secured with a screw.

Figure 29:
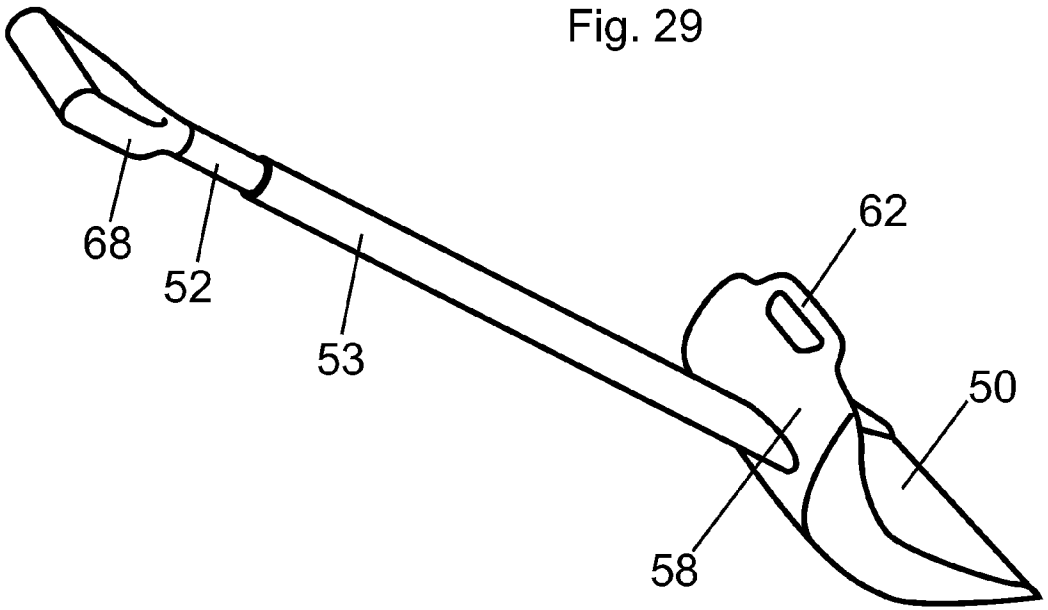
FIG. 29 is a perspective view of an enhanced shovel as shown in FIG. 28, having its virtual integral trapezoidal structure engineered to provide additional strength and stability. There is, consequently, no need for a tubular structure to attach the tee-grip to the original handle. This figure has an adjustable locking telescoping handle to accommodate individuals' preferred spans between grips.

FIG. 29 resembles FIG. 28 with the exception that the trapezoidal area 58 has been strengthened sufficiently to maintain its integrity without an auxiliary long tube 64, allowing for the substitution of handle 54 with a telescoping handle 52 and 53, which is designed to lock in a variety of ergonomically and comfortable position to accommodate preferred spans of different users between grips 68 and 62.

Figure 3B:
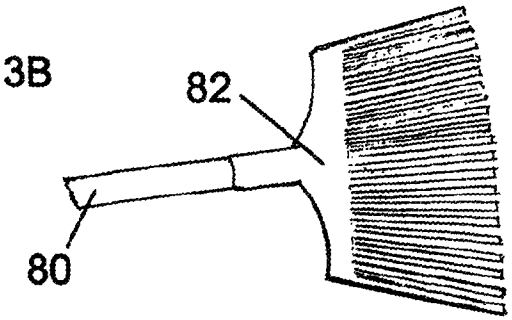
FIGS. 3A-3D include a perspective view of another embodiment of the device, in which an active upper forearm support is attached to a traditional straight handle, which is shown terminating in three typical alternative tool heads, a leaf rake, a squeegee and a push broom.
Figure 3A:
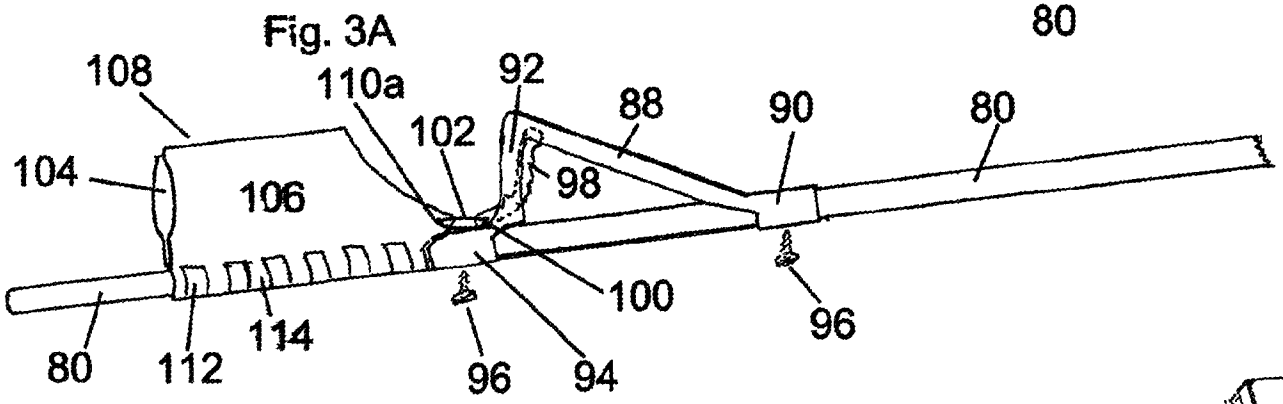
Figure 3D:
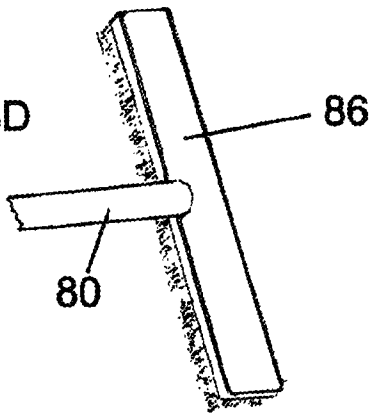
Figure 3C:
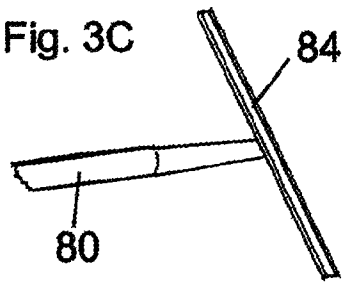

FIGS. 3A-3D show an alternate embodiment of the current invention configured to apply to a different class of tools, examples of which include a leaf rake, squeegee and push broom, all of which are operable in a normal pushing and pulling fashion. FIG. 3A depicts a straight solid or tubular handle shaft 80, which may be selectively fitted at its lower end to a leaf rake head 82, a squeegee head 84 or a push broom head 86. The shaft is fitted with an auxiliary handle in accordance with the invention that includes a tube member 88 which has been cut around approximately 270 degrees of its circumference near its lower end and bent at that point so as to fit over and contain the straight shaft 80 through a cylindrical collar 90 at the lower end. The tube member 88 then continues upwards at an acute angle with the straight shaft 80 and, at a distance, bends back towards the straight shaft 80 in a manner so as to form an angle that may be approximately 80° with the straight shaft 80, thereby forming a hand grip at 92, and finally, thereafter, tube 88 makes a sharp angle and is cut around approximately 270° of its circumference, ending in another upper cylindrical collar portion 94, allowing the upper end of the tube member 88 to fit over and contain the straight shaft 80 in the upper, cylindrical collar portion 94. The collars of tube member 88 may be secured to the straight shaft 80 using screws 96.

An operable forearm support system is also provided and a partial embodiment is also pictured as an enlarged fragmentary exploded view in FIG. 18.

A control lever 98 is contained within, and protrudes from, tube member 88 in the vicinity of the hand grip, as shown in FIG. 3A, and near upper cylindrical collar portion 94. The control lever 98 pivots on its own fulcrum contained within the tube 88 and has a hole 100 in its other end where a link 102 is connected that further connects the control lever 98 to corresponding holes (one of which is shown at 110 and another is shown at 110*a* in FIG. 18) in two opposed, converging halves 104 and 106 of a movable forearm support 108. The left half of a movable forearm support 104 and the right half of the movable forearm support 106 both are mounted on and contain the straight handle shaft 80 through a series of curved fingers or circular slotted extensions, as at 112 and 114. These fingers or extensions of the two halves of the movable forearm supports 104 and 106 are staggered so as to allow each half to rotate freely about the straight solid or tubular shaft 80. In addition, the end of the tube member 88 is tapered to form a wedge as it terminates along the straight tubular shaft adjacent to cylindrical collar portion 94 of tube member 88.

The control lever 98 is activated via link 102 inserted through holes 110 and 110*a* in the two movable forearm support halves 104 and 106 and through hole 100 in the control lever by pulling the two halves of the moveable forearm support 104 and 106 forward by grasping the hand grip 92. Moving control lever 98 forces the halves to rotate towards each other as they approach the tapered wedge-shape of the tube 88.

With the device configured as shown in FIGS. 3A-3D, with a variety of tool heads one can perform chores such as raking leaves, cleaning windows and sweeping floors more ergonomically using only one arm, than is traditionally possible with a single straight handle. The movable forearm supports 104 and 106 quickly and easily enclose the user's forearm with just a squeeze of the control lever 98 in the hand grip, thereby providing a solid and stable means of moving and controlling the tool and switching from one arm or user to another.

This configuration allows a user to rake leaves from a normal upright walking position, lifting the rake head by using the forearm and elbow as a fulcrum, and reducing the need to twist one's back or to push down with the back hand while the front hand lifts the rake, as in traditional rake designs. In addition, when drawing the device back toward the user while raking, it is now natural to use an easy orbital motion created by the movement of the arm and shoulder, instead having to stretch and move two arms in the cross-body motion necessitated by conventional rakes.

In using the device shown in FIG. 3A connected to a squeegee, one is provided the additional advantages of being able to reach higher by only having to use one arm to operate the device and also of being able to apply more force since one can push with one's forearm, while using the elbow as a fulcrum. Traditional squeegees would require one hand to push while the other would pull (serving as a fulcrum) and do not allow one to push as hard, while also risking back and muscle pain.

When using the device shown in FIG. 3A connected to a push broom, a user is able to ergonomically operate the device with one arm, in a comfortable, walking position, instead of with two hands as is typical with a traditional long-handled straight shaft push broom. In addition, one could even choose to push two such devices simultaneously and it is envisioned that one familiar with the art could fasten two such devices together to function in a dual configuration.

Finally, for the present invention, as configured for the devices shown in FIG. 3A and other devices having the movable forearm support, it becomes possible to effectively shorten the overall length of the tool, as the one-handed design obviates the requirement for the extra length normally used for a user to place two hands, simultaneously on the handle in order to forcefully push forward the device, as well as to either lift or press downward the tool's head, by using one of the two hands as a fulcrum.

FIGS. 4 and 5 show the left half of the movable forearm support 104 and the right half of the movable forearm support 106 with holes 110*a* and 110 for attaching them together and to the control lever 98 (FIG. 3A), as well as the curved fingers or circular slotted extensions on their central edges 112 and 114, which are used to hold them on a straight shaft and allow them to rotate about the shaft.

Figure 6:
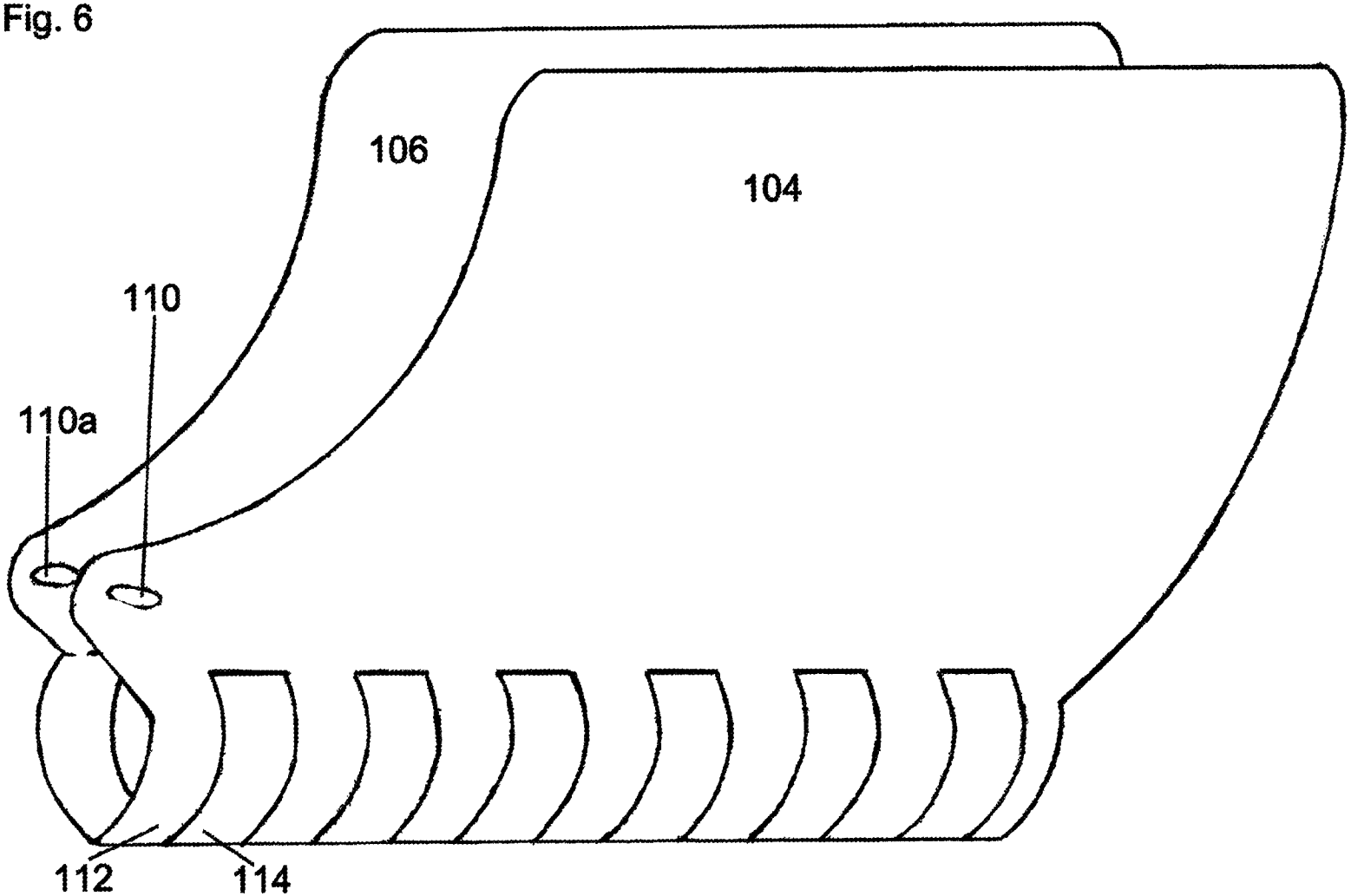
FIG. 6 is a perspective assembled view of the movable forearm support shell, ready to be inserted onto a handle shaft, as well as connected to the oval link used to connect the two sides to a hand grip control lever, as shown in FIG. 3.

FIG. 6 shows the two halves of the movable forearm support 104 and 106 placed together as they would be when being mounted about a straight shaft. FIG. 6 also shows the two corresponding holes 110 and 110*a* which would be connected with link 102 to the hole 100 in the lower end of the control lever, when fully assembled.

FIG. 7 shows how the circular extensions of the two halves 104 and 106 are shaped by presenting an end view of the two halves properly positioned, as they are disposed awaiting the insertion of a straight shaft.

FIGS. 8-11 depict an embodiment applied to a snow shovel 120 that includes a blade 122 having a handle socket 124 and a traditional straight tubular or solid shaft 126 inserted in the socket of the blade. A tubular trapezoidal structure 128 is secured to the blade 122 as by suitably secured removable bolts 130 located toward the ends of the bottom (longer) segment 132 of the trapezoidal structure 128.

The upper segment or top of the tubular trapezoidal structure 128 contains a tee member 134, which further joins with a bushing 135, the tubular trapezoidal structure 128 to a long tube 136, thereby forming a cross hand grip, which extends from the tee joint 134 away from the blade end of the shovel along the straight shaft 126. The tube member 136 is provided with a cylindrical collar 137 that attaches the mid portion of the tubular member 136 to the straight shaft 126. This cylindrical section 137 is formed by making a cut of approximately 270° of the circumference of the cylindrical section and bending the cylindrical section at an approximately 20° angle to the rest of the tube 136. The tube 136 may be secured to the straight shaft 126 with a removable device such as a screw through cylindrical section 137.

The tube 136 extends further along the shaft 126 away from the blade end of the shovel until it bends back, returning to the straight shaft 126, forming a hand grip 138, and thereafter, makes a sharp angle where the long tube 136 is again cut around approximately 270° of its circumference allowing the final end of the long tube 136 to capture the straight tubular shaft 126, where it may be secured to the straight tubular shaft at 140, as by a screw 142. A conventional D handle is attached and shown at 144 attached to shaft 126.

Figures 8, 9, 10, 11:
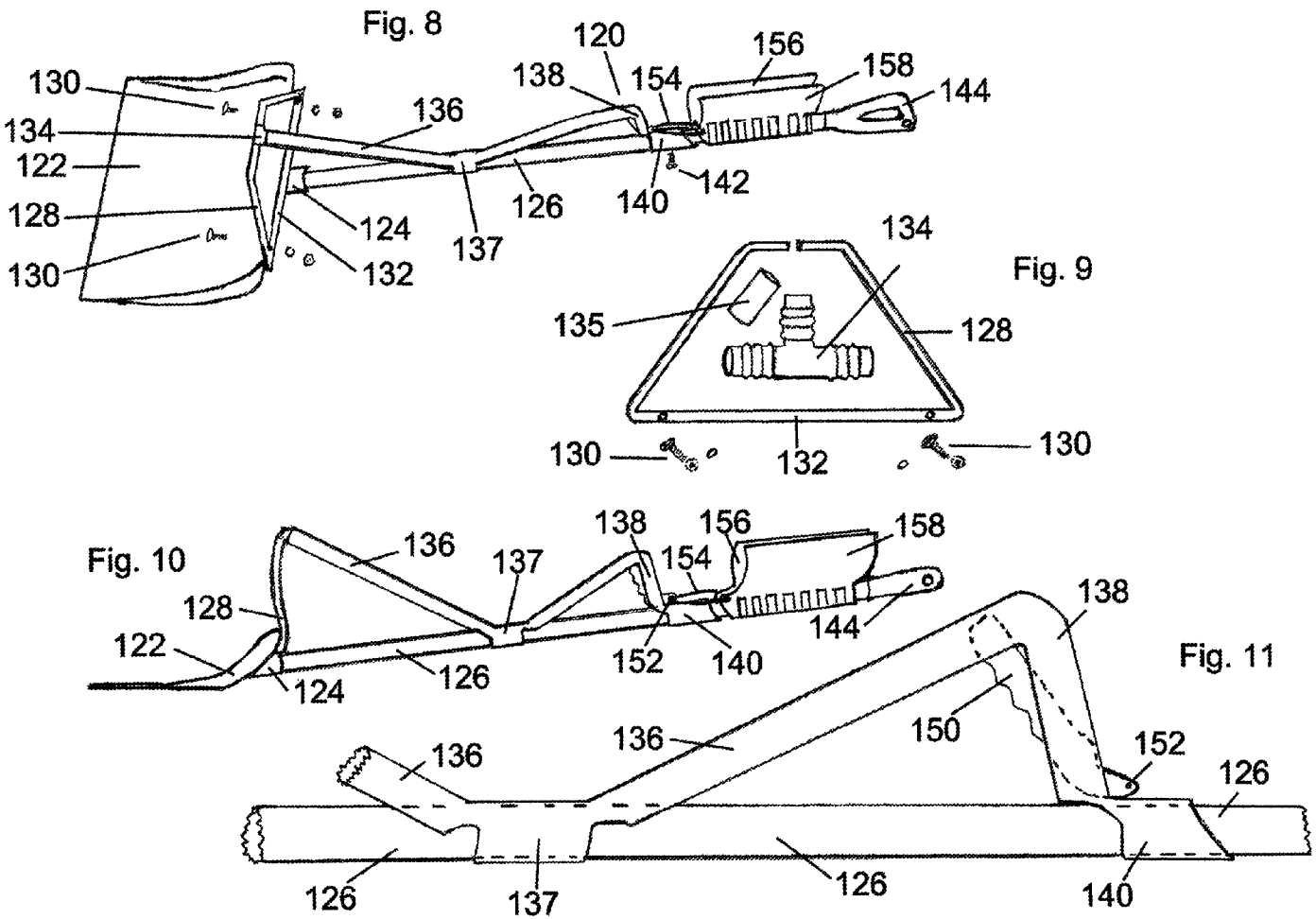
FIG. 8 is a perspective view of a snow shovel incorporating another embodiment of the device in which a lower auxiliary handle with a tubular trapezoidal structure engages the shovel head and another longer tube attaches the trapezoid to a conventional straight handle shaft before continuing upwards to terminate in an active upper forearm support, with hand grip and control lever.
FIG. 9 is a top plan view of the tubular trapezoidal structure of FIG. 8 with attaching screws and an enlarged drawing of the tee fitting to join the trapezoid to the longer tube.
FIG. 10 is a side view of the snow shovel shown in FIG. 8.
FIG. 11 is a side view of the upper portion of the longer tube as it meets and encompasses the traditional straight shaft before continuing onwards to form a hand grip, with enclosed control lever, and terminating by again enclosing the traditional straight handle shaft.

The embodiment of FIGS. 8-11, similar to that shown in FIG. 3A, includes a control lever 150 contained within the tube 136 in FIG. 11 at the point of making the final bend down toward the straight shaft 126. As in other embodiments, the control lever 150 pivots on its fulcrum where it is partially contained within the hand grip portion of the long tube 136 and has a hole 152 near a second end where a link 154 is connected and which also connects the control lever 150 through corresponding holes to two halves 156 and 158 of a movable forearm support, which operates in the manner of that described with reference to FIG. 3A. FIG. 9 shows the tubular trapezoidal structure 128, along with the bolts 130 and an enlarged drawing of the tee joint 134, which connects the upper tubular trapezoidal structure together to form the upper segment of the tubular trapezoidal structure 128.

FIG. 10 shows a side perspective view of the snow shovel of FIG. 8. FIG. 10 also shows the link 154 used to connect the control lever 150 with the two sides 156 and 158 of the movable forearm support.

FIG. 11 is an enlarged drawing of a fragment of FIGS. 8 and 10 showing the portion of the device where the long tube 136 meets and encircles the straight shaft 126 at 137 and then continues upward towards the user only to bend again to form the hand grip 138 and enclose the control lever 150, shown with its attachment hole 152, and again encircle the straight tubular shaft 126 at 140.

In operation, the snow shovel device shown in FIGS. 8-11 allows a user to easily shovel or push snow with one arm and while remaining mostly upright. The lower, longer segment of the tubular trapezoidal structure provides a convenient and effective foot pad for applying additional force to push the blade into snow.

The forearm support easily secures the device to the user's arm, making it easy to steer and operate the snow scraper from an ergonomically-favorable upright position. This requires less back movement and limits the range of motion needed by the user in order to perform the operation. Securing the forearm support using halves 156 and 158 to the user's arm is simply a matter of squeezing or releasing the control lever 150 in the hand grip area 138 of the long tube 136 and is therefore quick and easy. This feature also facilitates switching arms or users. In this manner, the auxiliary device relocates the effective steering control point from the wrist to the elbow/shoulder area resulting in a substantial reduction in the role of and strain exerted upon the wrist of the user.

The task of lifting and carrying snow also is greatly facilitated by the tubular trapezoidal support 128 which provides an elevated cross grip at the tee junction 134, as well as an additional grip area along the long tube 136, between the tee junction 134 and its intersection with the straight tubular shaft at 137. In addition to reducing the need of the user to bend over in order to pick up and carry a loaded blade, the device locates the effective center-of-gravity of the load almost directly below the cross grip handle. This reduces the strain placed on the user's back. Because of the tubular trapezoidal structure 128 and its attachment to the straight tubular shaft, here also a tripod-like stability is created for the device, reducing the tendency of the loaded blade to twist and unintentionally dump its contents, which thereby obviates the need of the user's wrist to be held tight around the hand grip, as would typically be the case with traditional shovels.

FIGS. 12-17 show a further embodiment of an auxiliary device which can be added to a device for snow shoveling and scraping in its shoveling orientation. The device contains a blade 182 for the scraping and shoveling of snow having a handle socket 184 with a traditional straight solid or tubular shaft 186 inserted in it, as well as a modified tubular trapezoidal structure 188 secured to the blade through two flathead carriage bolts 190 inserted through square holes in the blade 182 and held by corresponding lock washers 192 and nuts 194. The trapezoidal structure is secured through holes near each of the two ends of a bent bottom (longer) modified segment 196 of the modified trapezoidal structure 188. An axle 197 (FIG. 13) is provided that extends through the upper (shorter) section of the trapezoidal tubular structure 188 and carries two wheels 198 attached by retainer clips 199.

The upper segment or top of the modified tubular trapezoidal structure is connected through a tee 200 which further joins the modified tubular trapezoidal structure to an auxiliary long tube 202, thereby forming a cross hand grip, which continues from the tee 200 away from the blade 182 of the shovel and intersects the straight shaft 186, capturing the shaft 186 through an oval opening 204 in the tube 202. In a manner similar to previous embodiments, the tube 202 continues along its original orientation away from the blade and bends toward the straight tubular shaft 186, forming a hand grip at 206, and thereafter bends in a sharp angle where the tube 202 is cut around approximately 270° of its circumference allowing the final end of the long tube 202 to contain the straight tubular shaft 186 in a cylindrical collar 208 secured to the straight tubular shaft 186 with a screw 210.

Figures 12, 13, 14, 15, 16, 17:
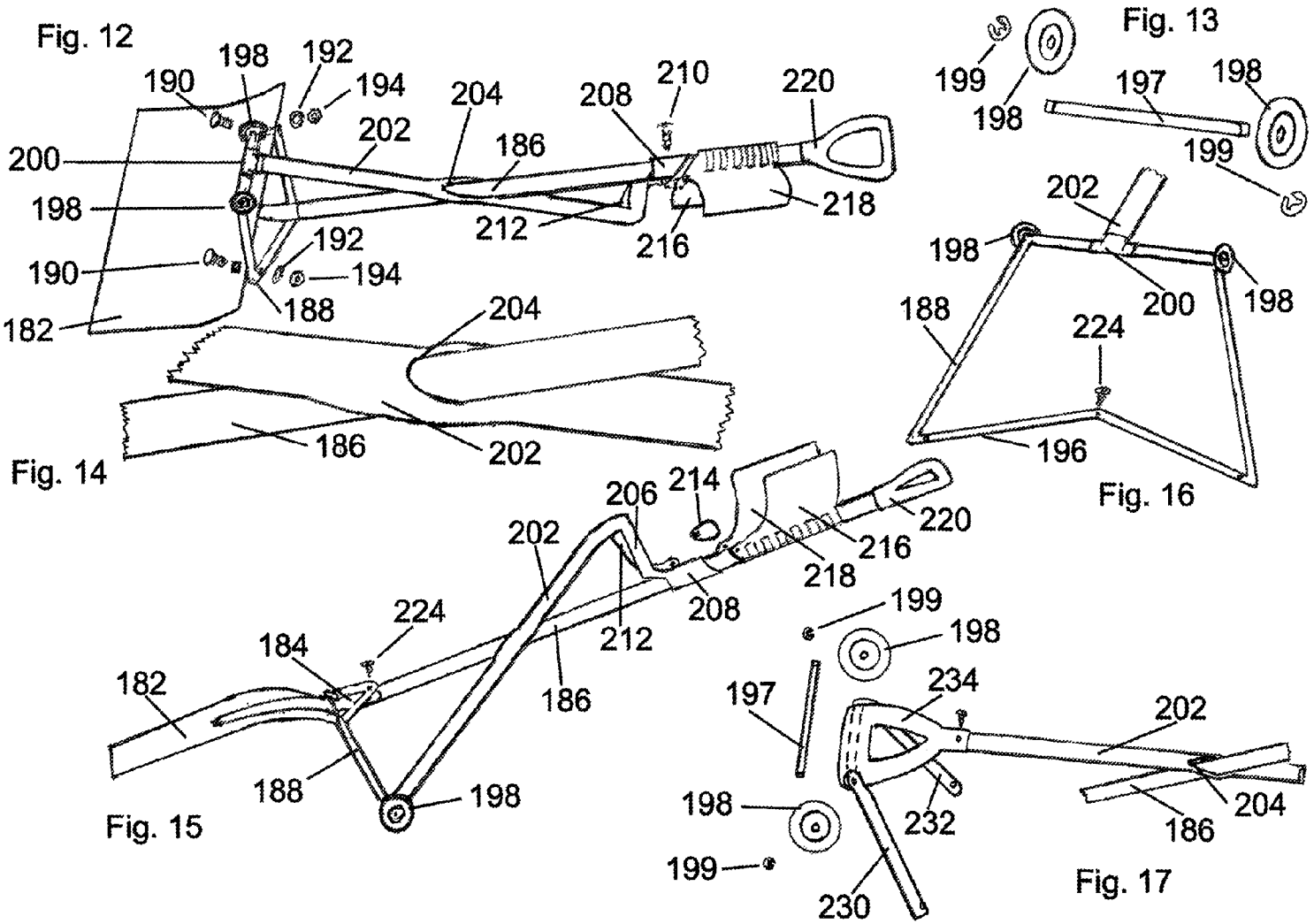
FIG. 12 is a perspective view of a snow shovel/scraper incorporating another embodiment of the device in which a lower auxiliary handle with a modified tubular trapezoidal structure has axle-mounted wheels on top, engaging the shovel/scraper head and a longer tube extends from the trapezoid, enclosing the traditional straight handle shaft, continuing to the opposite, lower, side of the shaft where it terminates in an active upper forearm support, with hand grip and control lever.
FIG. 13 is an exploded view of the axle assembly enclosed within the upper modified tubular trapezoid structure of FIG. 12.
FIG. 14 is a perspective view of the long tube encompassing the traditional straight handle shaft as in FIG. 12.
FIG. 15 is a perspective view of the snow shovel/scraper of FIG. 12 when it is turned over from its shoveling position to its scraping position, so that it rolls on the wheels mounted on an axle enclosed in the modified tubular trapezoidal structure, and where the active upper forearm support can be used.
FIG. 16 is a perspective view of parts of the modified tubular trapezoidal structure having a bent lower (longer) segment (which serves as a brace for the original handle) and joined to itself at the middle of the upper (shorter) segment by a tee junction.
FIG. 17 is a perspective view, with parts broken away, of an alternative D handle snow shovel/scraper implementation of the trapezoidal structure, which in this variation is created from a D handle (secured to two side supports by an axle contained within the D handle) attached to the longer tube which encloses the straight handle shaft before terminating; the trapezoidal geometry being completed in this implementation by the shovel head, itself, when the two side supports have been bolted to the shovel head.
Figure 1B:
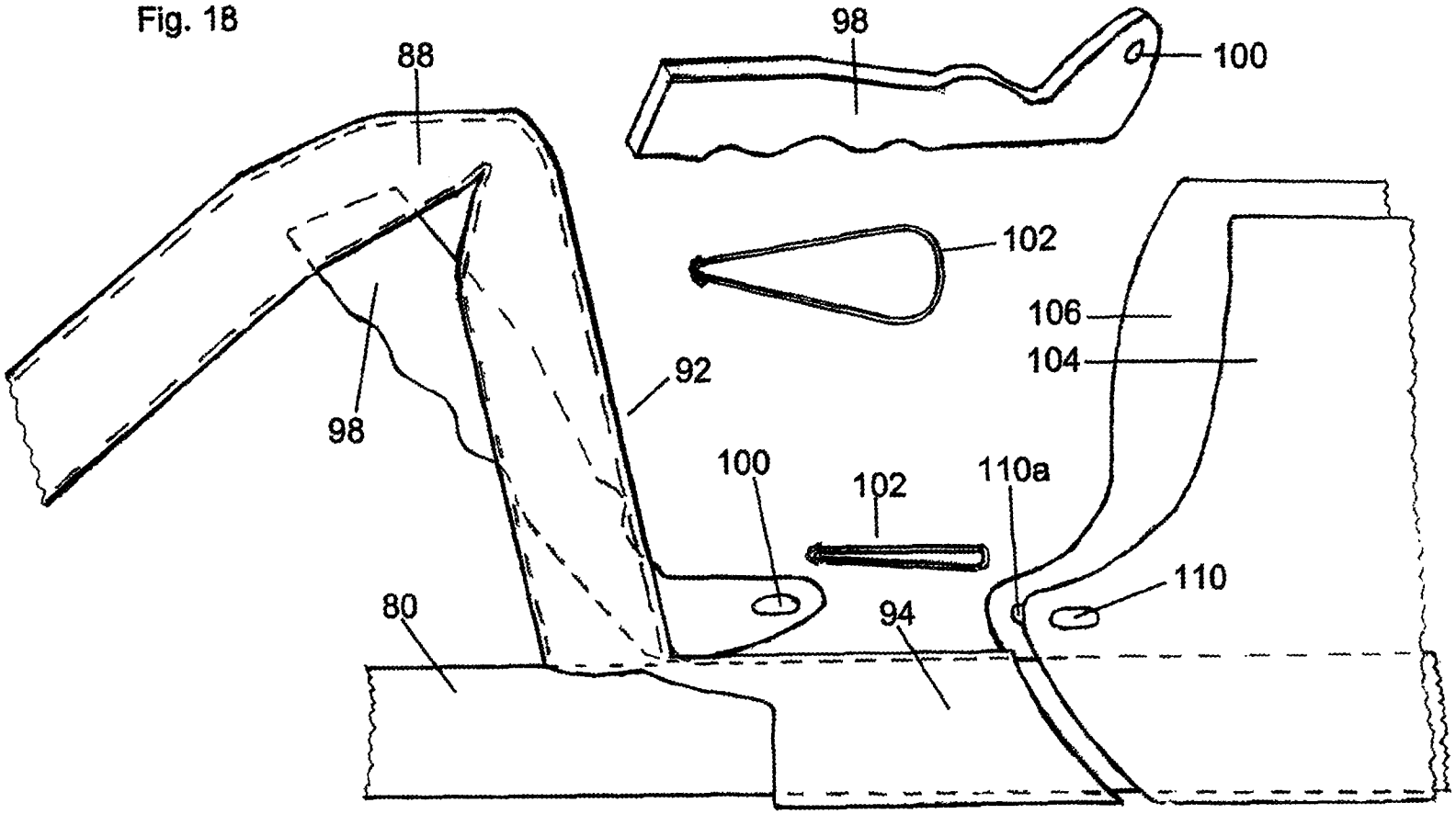

Also in the manner of previous embodiments, a control lever 212 is contained within the tube 202 (as shown in FIG. 15) in the hand grip area, which pivots and operates using a link 214 to operate two halves 216 and 218 of a movable forearm support.

A typical D handle 220 is shown attached to the traditional straight shaft 186 as it continues beyond the movable forearm supports 216 and 218.

FIG. 14 shows the intersection of the tube 202 with shaft 186 and illustrates how the tube 202 has been opened and deformed so as to allow the straight shaft 186 to pass through it.

FIG. 15 shows the device for the shoveling and scraping in an inverted scraping orientation. The device contains the blade 182 for scraping and shoveling secured to the modified trapezoidal structure 188 with a retaining screw 224 at the point that the longer segment of the modified trapezoidal structure 188 is bent to meet the blade 182 and where the traditional straight shaft 186 has been inserted in the neck 184. FIG. 16 shows the wheels 198 along with the normally hidden and enclosed axle 197 along with one retainer clip 199.

FIG. 16 shows modified trapezoidal structure 188 with its longest segment bent and with its two ends joined on its shorter (upper) segment to the long tube 202 by a tee junction 200. The wheels 198 are shown mounted on the hidden axle using a retainer clip 199.

FIG. 17 shows a fragmentary view of an alternative implementation using a modified tubular trapezoidal structure somewhat similar to those used in the snow shovel/scraper embodiment. In this figure, the modified tubular trapezoidal structure 188 and tee 200 are replaced by the two side supports 230 and 232 having one end connected through a D handle 234 with a contained axle 197 and a second end fastened to the blade (not shown). Wheels 198 are shown with axle 197 which is designed to be inserted through D handle 234.

The snow shovel/scraper device shown in FIGS. 12-16 allows a user to easily scrape snow one-handedly and to control the angle of attack of the blade 182 accurately and consistently, as well as to conveniently move the device, due to the fulcrum created by the modified trapezoidal support 188 and its attached wheels 198. The blade 182 may be used to scrape ice and snow and in this orientation is therefore not borne directly by the user, as would otherwise be the case. Ease of transport to and from storage can also be a significant feature, as effective ice and snow scraper blades are often made of heavy and thick materials. Because the forearm support easily secures the device to the user's arm, it is simple to steer and operate the snow scraper in an ergonomically-favored upright position, requiring less back movement and limiting the range of motion needed by the user in order to perform the operation. Securing the forearm support to the user's arm, as with other embodiments, is simply a matter of squeezing or releasing the control lever 212 in the hand grip area 206 of the tube 202 and is therefore quick and easy, also facilitating the switching of arms or users. The relocation of the effective steering control point from the wrist to the elbow/shoulder area results in a substantial reduction in the role of and strain exerted upon the wrist.

When the snow scraper device is used as a shovel or pusher as shown in FIG. 12, the task of lifting and carrying snow or ice is greatly facilitated by the modified tubular trapezoidal support 188, which provides an elevated cross grip at the tee junction 200, as well as an additional grip area along the long tube 202, between the tee junction 200 and its intersection with the straight tubular shaft 186. In addition to reducing the need of the user to bend over in order to pick up and carry a loaded blade 182, the device locates the effective center-of-gravity of the load almost directly below the cross grip handle. This reduces the strain placed on the user's back. Because of the modified tubular trapezoidal structure 188 and its attachment to the straight tubular shaft, a tripod-like stability is created for the device, reducing the tendency of the loaded blade to twist and unintentionally dump its contents, which thereby obviates the need of the user's wrist to be held tight around the hand grip, as would typically be the case with traditional shovels.

Figures 25, 26, 27:
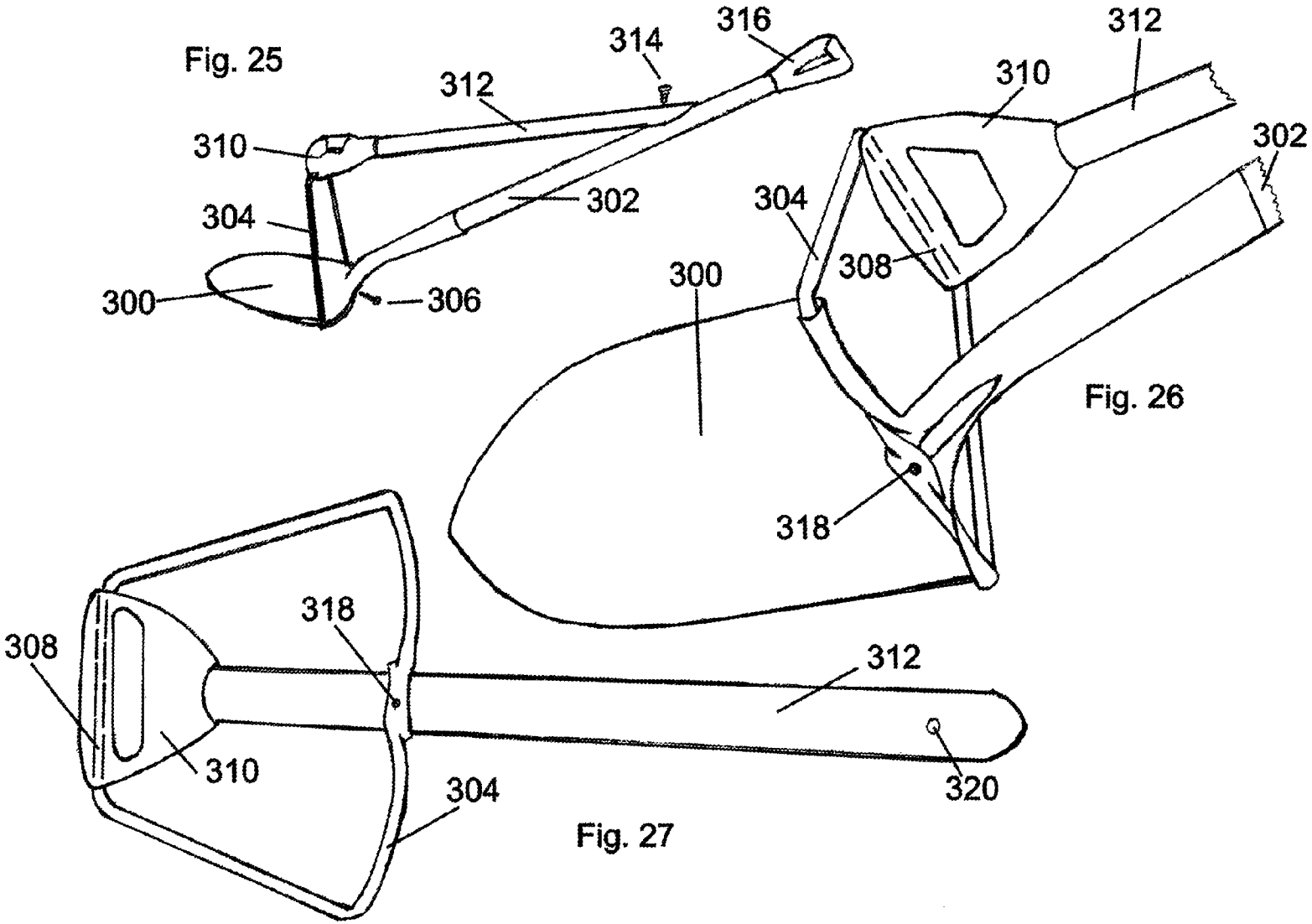
FIG. 25 is a perspective view of a round-pointed shovel incorporating one embodiment of the invention in which a lower auxiliary handle comprising a trapezoidal structure engages the shovel head and forms an ergonomic auxiliary handle through the inclusion of a D handle in the trapezoid which attaches to a longer shaft, extending from the top of the trapezoid to the traditional straight handle, where it meets and is secured with a screw.
FIG. 26 is an enlarged bottom perspective view of the round-pointed shovel of FIG. 25 with the bottom of the trapezoid fit into place at the back curled edge of the shovel head and with the top of the trapezoid passing through the D handle.
FIG. 27 is a top plan view of the trapezoidal structure of the embodiment of the invention shown in FIG. 25 attached through the D handle to the long shaft and rotated to fold along nearly the same plane as the long shaft, to facilitate space-saving storage or shipping.

FIG. 25 shows another alternate embodiment of the current development configured to suit a round-pointed shovel in its normal pushing or carrying orientation. The device contains a shovel head 300 suitable for shoveling dirt, sand or other substances, with a traditional straight cylindrical shaft 302 inserted in it, as well as a trapezoidal structure 304, made from a length of metal rod, or the like, secured to the shovel head 300 as by a screw 306 at the bottom of the trapezoidal structure 304, near where the ends of the rod used to form the trapezoidal structure have been welded together (shown in FIG. 27). The upper segment of top of the trapezoidal structure 304 passes through a hollow or drilled-out center 308 of a D hand grip 310, which serves also to connect the trapezoidal structure 304 with a shaft 312, which continues until it terminates and attaches to the traditional straight cylindrical shaft 302 with a screw 314. FIG. 25 also shows another D handle 316 attached to the upper end of the traditional straight cylindrical shaft 302.

FIG. 26 shows another view of the round-pointed shovel embodiment, with the trapezoidal structure 304 properly installed along (and engaging) the trailing edge of the shovel head 300 and secured to the shovel head 300 with a screw 306 through hole 318 in the center of the welded portion of the trapezoidal structure 304. The D handle 310 is again shown with the trapezoidal structure 304 passing through it, as well as attached to shaft 312.

FIG. 27 shows a top plan view of the trapezoidal structure 304 assembled through the D handle 310 and pivoted so as to lie in nearly the same plane as shaft 312 to which the D handle 310 is attached. The hole 318 is shown at the weld to accept an attachment screw. The hole 320 in shaft 312 is shown, where a screw 314 (in FIG. 25) would be used to secure it to shaft or handle 302.

The modified round-pointed shovel shown in FIG. 25, allows the user to more easily lift, carry and throw dirt, sand or other substances, by taking advantage of the trapezoidal structure 304 attached to the back of the shovel head 300, which provides an elevated grip above the center-of-gravity of the load in the shovel head 300. In addition, the additional length of shaft 312, which rises from shaft or handle 302 until it terminates in the D handle 310 at the top of the trapezoidal structure 304, provides additional gripping areas.

In addition to reducing the need for the user to bend over in order to pick up and carry a loaded shovel head, the auxiliary device locates the effective center-of-gravity of the load almost directly beneath the D handle 310. This reduces the strain placed on a user's back. Because of the trapezoidal structure 304 and its attachment to the traditional straight cylindrical shaft handle, a tripod-like stability is created, reducing the tendency of the loaded blade to twist and unintentionally dump its contents, which thereby obviates the need of the user's wrist to be held tight around the hand grip, as would typically be the case with traditional shovels.

Many of the tasks which are performed using the present invention as a tool handle are among the least efficient and most demanding manual chores. In particular, shoveling operations have been notorious sources of pain and injury, due to the requirement of holding several muscles tightened for extended periods of time while under stress, as well as the requirement of twisting the torso and extending arms significantly away from the body while bearing heavy loads.

Handles designed to be operated using two hands normally require two tightened wrists to grasp the shaft to control twisting, provide a suitable point to apply force, and to steer the device. In the event of loaded devices such as shovel heads, these tightened wrists are continuously under much stress while pushing. Likewise, when elevating and carrying or throwing the load in a shovel, the wrists must be tightened to control the twisting and rotating of the handle, while simultaneously applying pressure upwards to lift (and possibly downwards by the other wrist).

Figure 30:
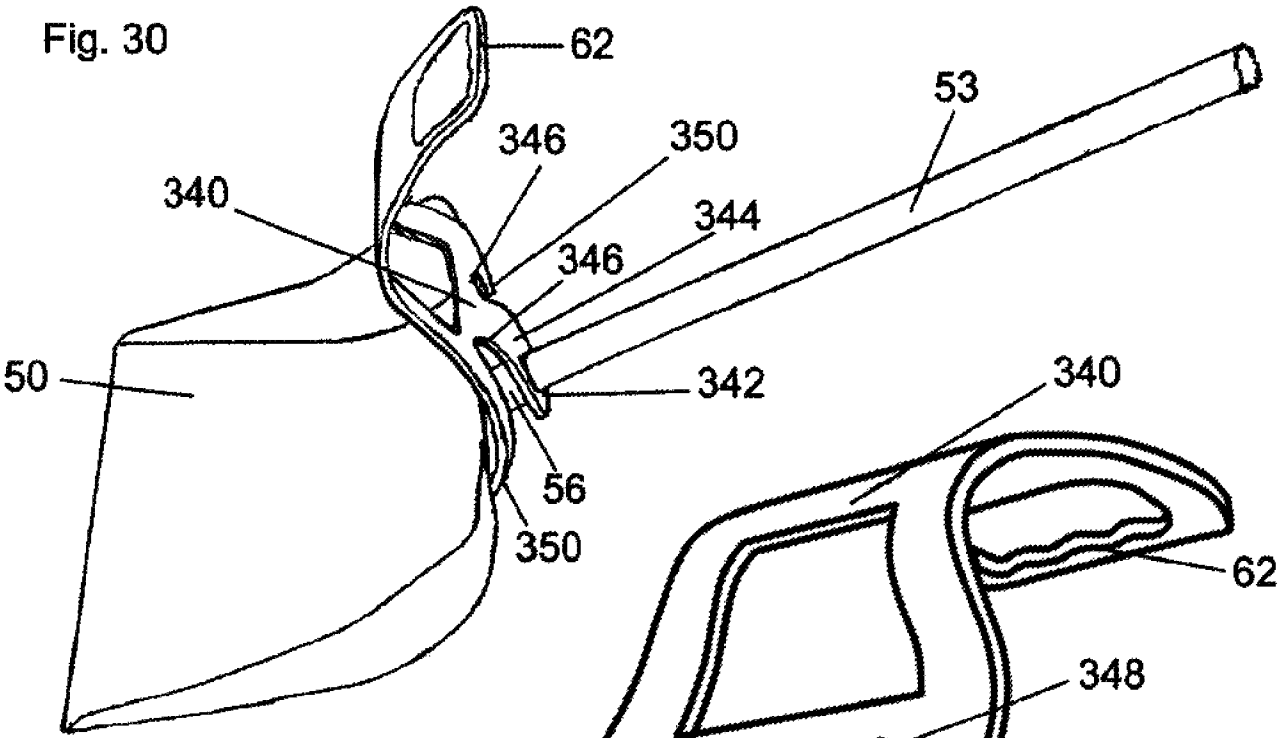
FIG. 30 is a perspective side view of a shovel, incorporating another embodiment of the development in which an auxiliary handle, in the form of a shaped, detachable unitary member containing an integrated hand grip and a curved virtual trapezoidal structure, is attached to a shovel head and handle forming a short tripod-like support member.

FIG. 30 shows another embodiment of the current development containing the virtual trapezoidal structure used in the embodiment shown in FIGS. 28 and 29, as a separate, unitary detachable member. The device contains a shovel head 50 attached to the straight, locking optionally telescoping handle 53, through the collar 342 of the integral central short tripod-like support member 344. The curved virtual trapezoidal structure 340 is further secured to the shovel head at bearing points 346 located on each side of the rear of the shovel head 50, through front-facing tabs 348 and rear-facing tabs 350 that extend from the trapezoidal structure on each side. As in previous embodiments, the integrated hand grip 62 is located above the handle socket 56, where the shovel head meets the lower portion 53 of the locking handle, which may be telescoping and locking, thereby ergonomically positioning the center of gravity of the shovel beneath the hand grip.

The trapezoidal structure 340 is shaped so that lifting at its hand grip 62 causes the collar 342 around the handle 53 to serve as a fulcrum, creating a downward force at bearing points 346 at the base of the trapezoidal structure 340 onto the shovel head 50. The front-facing tabs 348 and rear-facing tabs 350 extend from the base of the trapezoidal structure 340, supporting both the upper side and lower side of the tool head 50 at the bearing points 346, and secure each side of the trapezoidal structure 340 from sideways movement by using the collar 342 as a fulcrum. It can be seen in FIG. 31 that the front-facing tabs 348 and rear-facing tabs 350 can be shaped so as to conform to a variety of shovel head shapes and styles, thereby suitably accommodating numerous shovels already sold or on the market. Attaching the lower portion 53 of a straight, locking telescoping handle to the shovel head 50 at the handle socket 56, through the collar 342, secures the embodiment to the shovel.

Figure 31:
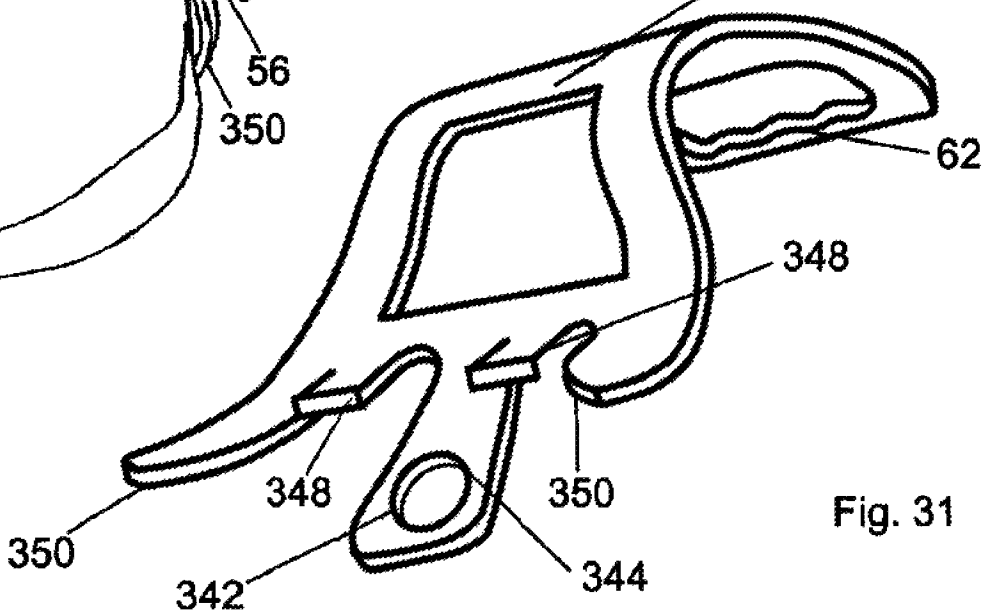
FIG. 31 is perspective rear view of the auxiliary handle shown in FIG. 30.

FIG. 31 shows the embodiment of the current development, shown attached to a shovel in FIG. 30, separately. The device is detachable and consists of a curved virtual trapezoidal structure 340, terminating as an integrated hand grip 62 at its upper end and terminating as a central collar 342 at its lower end, through which a handle would be inserted, flanked on either side by contoured front-facing tabs 348 and corresponding contoured rear-facing tabs 350. In addition to facilitating the shipping and storage of stacked unassembled units, this one-piece embodiment offers effective tripod-like control of the shovel, while ergonomically locating the center-of-gravity of the load beneath the hand grip, which itself is conveniently positioned some distance above the material to be shoveled. This embodiment, fabricated of light and strong materials, offers the advantages of the present invention with a minimum of weight and complexity.

It will be appreciated that the embodiments of the present invention have a common theme that present a flexible and efficient auxiliary device concept for providing a more ergonomic handle for many tools performing a variety of functions, thereby alleviating previous problems. They make it frequently possible to accomplish many previously two-handed operations with only one hand. They provide a stronger and more robust geometry which thereby allows the materials used to lighter and smaller in diameter, while continuing to satisfy the same requirements. The present invention provides for additional accuracy and control in performing many operations.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. An ergonomic auxiliary handling arrangement for a tool having a functional tool head at one end and an elongated tool handle or shaft optionally mounted in a handle socket extending away from said tool head, said auxiliary handling arrangement comprising:

a geometric shape designed to stabilize the tool head and having a main lower transverse portion extending across the tool handle, designed to be directly secured to said functional tool head unattached to the tool handle or handle socket and optimally including a portion of said tool head, and having a raised transverse portion generally parallel to, connected with, and spaced a distance above said main lower transverse portion designed to reside above said handle, said raised transverse portion of said geometric shape including one or more areas for hand gripping for ease of lifting said tool head, said auxiliary handling arrangement further acting in a manner such that said transverse portions of said geometric shape also stabilize said tool head against longitudinal movement, lateral movement and rotation; and a support member connected to and extending from said raised transverse portion of said stabilizing geometric shape to attach to said tool handle at an acute angle therewith.

2. An ergonomic auxiliary handling arrangement as in claim 1 wherein said stabilizing geometric shape is generally that of a trapezoid and wherein said one or more areas for hand gripping include a shorter side of two generally parallel sides and said main transverse aspect includes a longer of two generally parallel sides.

3. An ergonomic auxiliary handling arrangement as in claim 2 wherein said support member and said geometric shape are connected using a member selected from the group consisting of tee members and members comprising "D" handle shapes connected in said shorter side of said geometric shape.

4. An ergonomic auxiliary handling arrangement as in claim 3 wherein said support member is a tubular member.

5. An ergonomic auxiliary handling arrangement as in claim 4 wherein said support member includes a portion that forms a further hand grip area located along and at an angle with said tool handle.

6. An ergonomic auxiliary handling arrangement as in claim 5 wherein said further hand grip includes a lever connected to operate a releasable user-actuated and user-controlled forearm support that includes a pair of opposed shaped converging halves for capturing a forearm therebetween which are mounted on and contain said tool handle, said forearm support being operated and controlled by the hand of said forearm.

7. An ergonomic auxiliary handling arrangement as in claim 6 further comprising wheels associated with said geometric shape.

8. An ergonomic auxiliary handling arrangement as in claim 1 wherein said tool head is a form of a material handling device.

9. An ergonomic auxiliary handling arrangement as in claim 8 wherein said stabilizing hand grip is in the form of a "D" grip.

10. An ergonomic auxiliary handling arrangement as in claim 1 wherein said support member includes at least one integral collar that attaches to said tool handle.

11. An ergonomic auxiliary handling arrangement as in claim 1 wherein said geometric shape is a virtual shape designed into said functional tool head.

12. An ergonomic auxiliary handling arrangement as in claim 11 wherein said tool head is a form of a material handling device.

13. An ergonomic auxiliary handling arrangement as in claim 12 wherein said geometric shape is generally in the shape of a trapezoid or modified trapezoid.

14. An ergonomic auxiliary handling arrangement as in claim 11 wherein said geometric shape is generally in the shape of a trapezoid or modified trapezoid.

15. An ergonomic auxiliary handling arrangement as in claim 1 further comprising a releasable user-actuated and user-controlled forearm support attached to the tool handle to releasably capture a forearm of a user to increase the leverage thereof, said forearm support being operated and controlled by the hand of said forearm.

16. An ergonomic auxiliary handling arrangement as in claim 15 wherein said arrangement includes a further hand grip located along and at an angle with said tool handle, said further hand grip including an actuating lever connected to operate said releasable user-actuated and user-controlled forearm support.

17. An ergonomic auxiliary handling arrangement as in claim 15 wherein said operable forearm support includes a pair of opposed shaped converging halves for capturing a forearm therebetween which are mounted on and contain said tool handle.

18. An ergonomic auxiliary handling arrangement as in claim 1 further comprising wheels associated with said geometric shape.

19. An ergonomic auxiliary handling arrangement as in claim 18 wherein said geometric shape is a modified trapezoid.

20. An ergonomic auxiliary handling arrangement as in claim 1 wherein said geometric shape is constructed from material selected from tubes and rods.

21. An ergonomic auxiliary handling arrangement as in claim 20 wherein said arrangement is removably attached.

22. An ergonomic auxiliary handling arrangement as in claim 1 wherein said hand grip and said support member are formed from a unitary shaped member.

23. An ergonomic auxiliary handling arrangement as in claim 22 wherein said unitary shaped member comprises tabs to attach to said tool head and a collar that slips over said tool handle.

24. An ergonomic auxiliary handling arrangement as in claim 22 wherein said unitary shaped member is in the shape of a curved virtual trapezoid.

25. An ergonomic auxiliary handling arrangement as in claim 22 wherein said tool head is in the form of a material handling device.

26. An ergonomic auxiliary handling arrangement as in claim 1 wherein said arrangement is removably attached.

27. An ergonomic auxiliary handling arrangement for a tool for ergonomical tool operation comprising:

an auxiliary hand grip arrangement attached to a generally straight shaft tool handle, said auxiliary hand grip extending away from said generally straight shaft tool handle at an angle therewith and including a lever operable by gripping said auxiliary hand grip; and a releasable user-operated and user-controlled forearm support system comprising shaped opposed converging halves for capturing a forearm mounted on and containing said generally straight shaft tool handle and connected to be operated by said lever of said auxiliary hand grip, said forearm support being operated and controlled by the hand of said forearm.

28. An ergonomic auxiliary handling arrangement as in claim 27 wherein said auxiliary hand grip comprises a shaped tubular member removably attached to said generally straight shaft tool handle by a pair of integral collar members.

29. An ergonomic auxiliary handling arrangement as in claim 28 wherein said tool is a device operated in a pushed or pulled fashion.

30. An ergonomic auxiliary handling arrangement as in claim 27 wherein said tool is operable using one arm.

31. An ergonomic auxiliary handling arrangement for a tool having a functional tool head having a raised, rear portion at one end of the tool head and an elongated tool handle or shaft optionally mounted in a handle socket and extending away from said tool head, said auxiliary handling arrangement comprising:

a geometric shape designed to directly stabilize the tool head including a main transverse portion, extending laterally with respect to said handle, and crossing but not attaching to said handle, or said handle socket, designed to be contained or integrated within and extending along the raised, rear portion of said tool head and a raised transverse portion connected with said main transverse portion, and spaced a distance above said handle, said raised transverse portion of said geometric shape including one or more areas for hand gripping for ease of lifting said tool head, and wherein said transverse portions also stabilize said tool head against longitudinal movement, lateral movement and rotation; and wherein said geometric shape is a virtual shape designed into said functional tool head.

32. An ergonomic auxiliary handling arrangement as in claim 31 wherein said tool handle is a telescoping handle.

33. An ergonomic auxiliary handling arrangement as in claim 31 wherein said tool head is a form of a material handling device.

34. An ergonomic auxiliary handling arrangement as in claim 31 wherein said virtual shape is generally trapezoidal.

35. An ergonomic auxiliary handling arrangement as in claim 31, wherein said ergonomic auxiliary handling arrangement includes:

a support member extending from the stabilizing geometric shape to attach to said tool handle.

36. An ergonomic auxiliary handling arrangement for a tool having a functional tool head having a raised, rear portion at one end and an elongated tool handle or shaft optionally mounted in a handle socket and extending away from said tool head, said auxiliary handling arrangement comprising:

a geometric shape designed to directly stabilize the tool head including a main transverse portion extending laterally with respect to and crossing but not attaching to said handle, or said handle socket, designed to be rigidly secured directly to the raised, rear portion of said tool head and a raised transverse portion connected with and spaced a distance above said handle, said raised transverse portion of said geometric shape including one or more areas for hand gripping for ease of lifting said tool head, and wherein said transverse portions also stabilize said tool head against longitudinal movement, lateral movement and rotation; and a support member extending from said stabilizing geometric shape to attach to said tool handle;

wherein said geometric shape is formed from a shaped detachable unitary member.

37. An ergonomic auxiliary handling arrangement as in claim 36 wherein said unitary shaped member comprises tabs to attach to said tool head and a collar that slips over said tool handle.

38. An ergonomic auxiliary handling arrangement as in claim 36 wherein said unitary shaped member is in the shape of a curved virtual trapezoid.

39. An ergonomic auxiliary handling arrangement as in claim 36 wherein said tool head is in the form of a material handling device.

* * * * *